US007074023B2

(12) United States Patent
Matsunaga et al.

(10) Patent No.: US 7,074,023 B2
(45) Date of Patent: Jul. 11, 2006

(54) SCROLL COMPRESSOR

(75) Inventors: Kazuyuki Matsunaga, Ohira (JP); Kazumi Tamura, Ohira (JP); Atsushi Onuma, Ohira (JP); Isamu Tsubono, Ushiku (JP)

(73) Assignee: Hitachi Home & Life Solutions, Inc., Tokyo (JP)

( * ) Notice: Subject to any disclaimer, the term of this patent is extended or adjusted under 35 U.S.C. 154(b) by 0 days.

(21) Appl. No.: 10/901,972

(22) Filed: Jul. 30, 2004

(65) Prior Publication Data

US 2005/0100469 A1 May 12, 2005

(30) Foreign Application Priority Data

Nov. 10, 2003 (JP) ..... 2003-379563

(51) Int. Cl.
*F04C 18/00* (2006.01)

(52) U.S. Cl. ..... 418/55.1; 418/55.2; 418/75; 418/183; 418/186

(58) Field of Classification Search ..... 418/55.1, 418/55.2, 183, 186, 75, 77
See application file for complete search history.

(56) References Cited

U.S. PATENT DOCUMENTS 4,608,002 A * 8/1986 Hayase et al. ..... 418/270
4,889,471 A * 12/1989 Izunaga et al. ..... 418/94
5,501,584 A * 3/1996 Yamamoto et al. ..... 418/55.1
6,494,696 B1 * 12/2002 Terai et al. ..... 418/94
6,589,035 B1 * 7/2003 Tsubono et al. ..... 418/55.5

FOREIGN PATENT DOCUMENTS

JP 08074760 A * 3/1996
JP 11-336678 12/1999
JP 2000097175 A * 4/2000

* cited by examiner

*Primary Examiner*—Theresa Trieu
(74) *Attorney, Agent, or Firm*—Antonelli, Terry, Stout and Kraus, LLP.

(57) ABSTRACT

A scroll compressor enabling decrease of a flow path loss in a communication groove extending from a suction port toward a suction chamber to decrease a loss of suction power is disclosed. In the scroll compressor, a movable scroll is provided so as to perform a swivel motion relative to a fixed scroll, a fixed scroll lap and a movable scroll lap are engaged with each other to form a suction chamber and compression chambers, a suction port communicating with the suction chamber is formed in the fixed scroll, and a communication groove extending from the suction port toward the suction chamber is formed in the fixed scroll. The communication groove has a shape such that the bottom thereof is inclined so as to become shallower from the suction port side to the suction chamber side.

4 Claims, 4 Drawing Sheets

SCROLL COMPRESSOR

CLAIM OF PRIORITY

The present application claims priority from Japanese application serial JP 2003-379563 filed on Nov. 10, 2003, the content of which is hereby incorporated by reference into this application.

FIELD OF THE INVENTION

The present invention relates to a scroll compressor. Particularly, the invention is suitable for its application to a scroll compressor using refrigerant gas such as a refrigerator or an air conditioner.

BACKGROUND OF THE INVENTION

In a scroll compressor having a suction stroke in which refrigerant gas is introduced from a suction port into a suction chamber and further into the largest closed space of a compression chamber in the compressor, means has been proposed for ensuring communication the largest closed space with the suction port side until just before formation of the largest closed space in a compression chamber insofar as possible with a view to decreasing fluid resistance of the fluid to the compression chamber during suction.

As such a scroll compressor, one disclosed in Japanese Patent Laid-Open No. H 11(1999)-336678 (Patent Literature 1) is known for example.

In this known scroll compressor, upright spiral laps are provided on base plates of a fixed scroll and a movable scroll, as a fixed scroll lap and a movable scroll lap respectively, in such a manner that the movable scroll performs a swivel motion relative to the fixed scroll. The fixed scroll lap and the movable scroll lap are engaged with each other to form a suction chamber and compression chambers. A suction port communicating with the suction chamber is provide in the fixed scroll and further a communication groove extending from the suction port to the suction chamber is provide in the fixed scroll. The communication groove can communicate with the suction chamber until just before formation of the largest closed space in the compression chamber.

In the above publication it is shown that with the communication groove provide din the fixed scroll, the sectional area of the fluid flow path in the suction space increases and it is possible to decrease an agitation loss induced within the suction space by the movable scroll lap. It is also shown therein that by ensuring communication between the suction chamber and the communication groove until just before formation of the largest closed space in the compression chamber, it is possible to decrease a loss caused by a compressing operation involving leakage which is generated in the suction stroke.

[Patent Literature 1]

Japanese Patent Laid-Open No. H 11(1999)-336678 (FIG. 11)

In Patent Literature 1, however, there is found no disclosure regarding a flow path loss attributable to the shape of the communication groove itself formed in the fixed scroll. For example, it has turned out that the loss by the communication groove would increase extremely, if the communicating groove had a flat surface on the bottom and a depth which was able to make its communication between the suction port and the communication groove with their sufficient openings. With such a communication groove, refrigerant gas flowing from the suction port into the communication groove strikes against a vertical surface at the front end of the communication groove, resulting in that the flow of the refrigerant gas is greatly disturbed and the flow path loss caused by the communication groove becomes extremely large. In view of this point, if the communication groove is made shallow, there arises the problem that the flow path loss diminishing effect resulting from a decrease of the flow path resistance on the suction side by the communication groove is reduced by half.

In Patent Literature 1, for largest closed spaces in compression chambers formed on an inner line side and an outer line side of a winding end portion of the movable scroll lap, independent communication grooves are formed in the fixed scroll and the movable scroll, respectively, resulting in the structure becoming complicated and the cost becoming high.

SUMMARY OF THE INVENTION

It is an object of the present invention to provide a highly efficient scroll compressor by diminishing a flow path loss in a communication groove extending from a suction port to a suction chamber to decrease the loss of suction power.

It is another object of the present invention to provide a scroll compressor enabling decrease of a loss caused by a compressing operation involving leakage which is generated in a suction stroke and enabling formation of a communication groove of a less expensive structure which groove corresponds to largest closed spaces in compression chambers formed on an inner line side and an outer line side of a winding end portion of a movable scroll lap.

According to the present invention, for achieving the above-mentioned objects, there is provided a scroll compressor comprising upright spiral laps provided on base plates of a fixed scroll and a movable scroll as a fixed scroll lap and a movable scroll lap respectively, the movable scroll is mounted so as to perform a swivel motion relative to the fixed scroll, the fixed scroll lap and the movable scroll lap are engaged with each other to form a suction chamber and compression chambers, a suction port communicating with the suction chamber is provided in the fixed scroll, and a communication groove extending from the suction port to the suction chamber is provided in the fixed scroll. The scroll compressor is further comprising a bottom of the communication groove inclining shallowly from the suction port side toward the suction chamber side.

The following are preferred modes of the present invention:

(1) The suction port is provided vertically in the fixed scroll and the bottom of the communication groove is gently inclined from a side portion of the suction port toward the suction chamber.

(2) The suction port is provided vertically in the fixed scroll and the bottom of the communication groove is gently inclined linearly at an angle of not larger than 45 degrees from a side portion of the suction port toward the suction chamber.

(3) Winding ends of the fixed scroll and the movable scroll are displaced by approximately 180 degrees from each other.

(4) At the time of forming a largest closed space in a compression chamber on an inner line side of a winding end portion of the movable scroll lap, the communication groove is formed in such a manner that an inside end portion thereof extends approximately in conformity with and along the inside of the inner line of the winding end portion.

(5) Largest closed spaces in the compression chambers are formed alternately on an inner line side and an outer line side of a winding end portion of the movable scroll lap, and the communication groove is formed in such a manner that inner and outer end portions thereof extend approximately in conformity with and along the inside of the inner and outer lines of the winding end portion at the time of forming the largest closed spaces in the compression chambers.

(6) The suction port is provided vertically in the fixed scroll, the bottom of the communication groove is inclined from a side portion of the suction port toward the suction chamber, and a check valve is disposed in the suction port to prevent reverse-flowing of refrigerant gas from the suction chamber when the compressor is OFF.

According to the present invention, for achieving the foregoing another object, there is provided a scroll compressor wherein an upright, spiral, fixed scroll lap and a movable scroll lap are provided on base plates of a fixed scroll and a movable scroll, the movable scroll is mounted so as to perform a swivel motion relative to the fixed scroll, the fixed scroll lap and the movable scroll lap are engaged with each other to form a suction chamber and compression chambers, a suction port communicating with the suction chamber is formed in the fixed scroll, and a communication groove extending from the suction port to the suction chamber is formed in the fixed scroll. The compressor is characterized in that winding ends of the fixed scroll and the movable scroll are displaced by approximately 180 degrees from each other, largest closed spaces in the compression chambers are formed alternately on an inner line side and an outer line side of a winding end portion of the movable scroll lap, and the communication groove is formed in such a manner that inner and outer end portions thereof extend approximately in conformity with and along the inside of the inner and outer lines of the winding end portion at the time of forming the largest closed spaces in the compression chambers.

According to the present invention, it is possible to decrease a flow path loss in the communication groove extending from the suction port to the suction chamber and decrease a loss of suction power, whereby a highly efficient scroll compressor is obtained.

Further, according to the present invention there is provided a scroll compressor enabling decrease of a loss caused by a compressing operation involving leakage which is generated in a suction stroke and enabling formation of a communication groove of a less expensive structure which groove corresponds to largest closed spaces in compression chambers formed on inner and outer line sides of a winding end portion of the movable scroll lap.

DETAILED DESCRIPTION OF THE PREFERRED EMBODIMENTS

Figure 1:
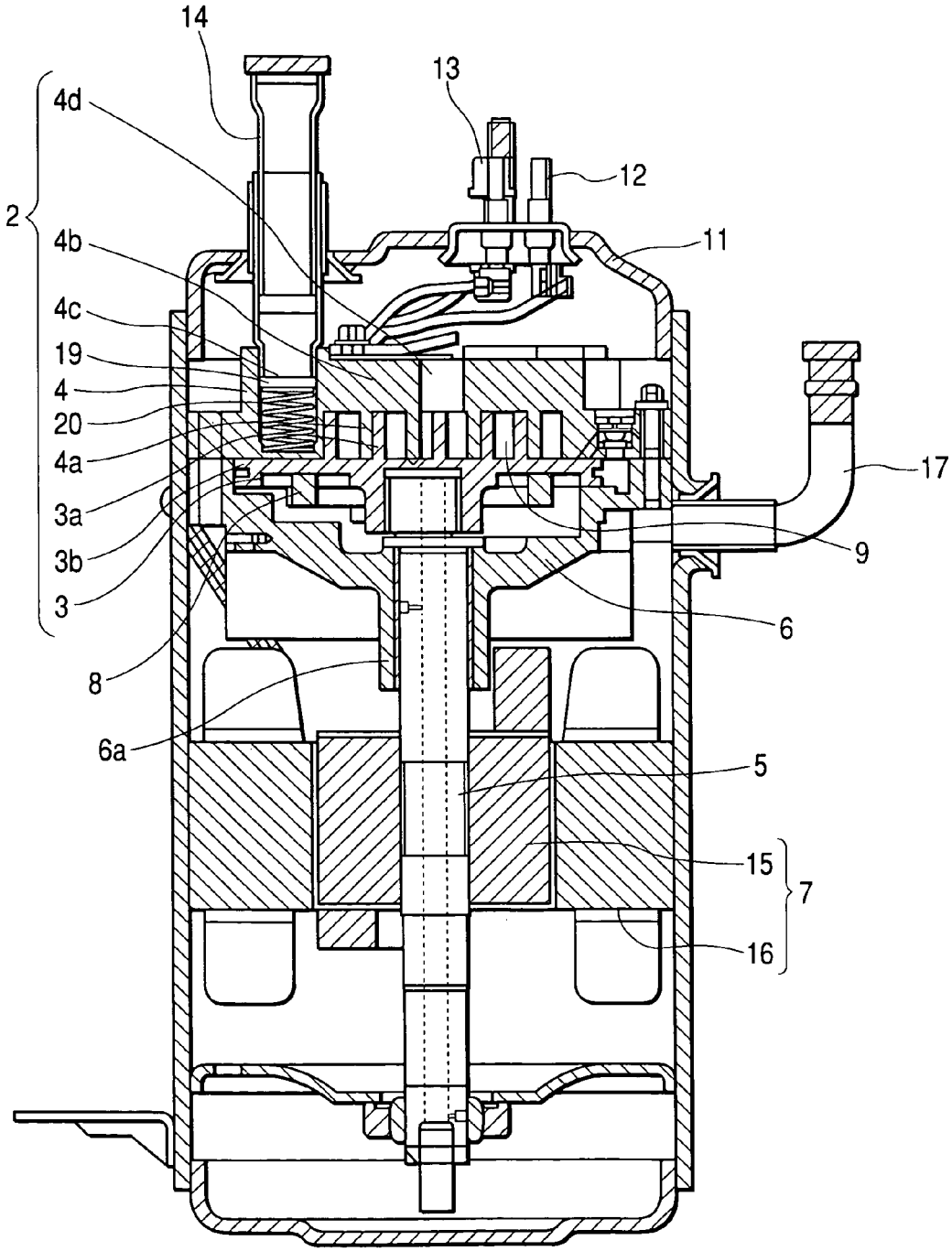
FIG. 1 is a vertical sectional view of a scroll compressor according to a first embodiment of the present invention.

Scroll compressors according to plural embodiments of the present invention will be described hereinunder with reference to the accompanying drawings. In connection with the following embodiments, the same reference numerals in the drawings represent the same or equivalent portions.

A scroll compressor according to a first embodiment of the present invention will be described below with reference to FIGS. 1 to 4.

The whole of the scroll compressor of this embodiment will now be described with reference to FIG. 1. FIG. 1 is a vertical sectional view of the scroll compressor of the first embodiment. The scroll compressor of this embodiment is used, for example, as a compressor using refrigerant gas such as a refrigerator or an air conditioner.

In FIG. 1, the numeral 1 denotes a hermetically sealed vessel, numeral 2 denotes a compressing mechanism, numeral 3 denotes a movable scroll, numeral 3*a* denotes a spiral lap of the movable scroll 3, numeral 3*b* denotes a base plate of the movable scroll 3, numeral 4 denotes a fixed scroll, numeral 4*a* denotes a spiral lap of the fixed scroll 4, numeral 4*b* denotes a base plate of the fixed scroll 4, numeral 4*c* denotes a suction port, numeral 5 denotes a crank shaft, numeral 6 denotes a frame having the fixed scroll 4 and a bearing for rotating the crank shaft 5, numeral 7 denotes an electric motor, numeral 8 denotes an Oldham's ring as a rotation preventing member for preventing the movable scroll from rotating on its own axis and for allowing it to perform a swivel motion, numeral 12 denotes a terminal, numeral 13 denotes a terminal cover mounting pin, and numeral 14 denotes a refrigerant gas suction pipe.

In the scroll compressor, the compressing mechanism 2 and the electric motor 7 are connected together through the crank shaft 5 and are received within the hermetically sealed vessel 1. The compressing mechanism 2 comprises the fixed scroll 4, movable scroll 3, frame 6, crank shaft 5 and Oldham's ring 8 as principal components.

The fixed scroll 4 includes the base plate 4*b* and the spiral fixed scroll lap 4*a* which is upright on the base plate 4*b*. The fixed scroll 4 is fixed with bolts to an upper side of the frame 6. An outer periphery portion of the frame 6 is fixed to the hermetically sealed vessel 1, and a bearing 6*a* for bearing the rotation of the crank shaft 5 is provided centrally of the frame 6.

The suction port 4*c* is formed in an outer periphery portion of the fixed scroll 4 so as to extend vertically from an upper surface (opposite-to-the-lap side) of the base plate 4*b*. A suction pipe 14 connected to an external cycle is press-fitted in an upper portion of the suction port 4*c*. A check valve 19 is disposed in the suction port 4*c* so as to be movable in the extending direction of the suction port 4*c*. The check valve 19 is pushed from the back side thereof by means of a spring 20 and can be abutted against an end portion of the suction pipe 14. A discharge port 4*d* is formed centrally of the fixed scroll 4.

The movable scroll 3 includes the base plate 3*b* and the spiral lap 3*a* which is upright on the base plate 3*b*. The movable scroll 3 is disposed so as to perform a swivel motion relative to the fixed scroll 4. With the Oldham's ring 8 as a rotation preventing member, the movable scroll is allowed to swivel without rotation on its own axis.

By the fixed scroll 4 and the movable scroll 3 engaged together with their spiral laps 4*a* and 3*a* positioned inside, the compressing mechanism 2 forms compression chambers 9 and a suction chamber 10. The suction port 4*c* of the fixed scroll 4 is formed so as to communicate with the suction chamber 10.

The electric motor 7 comprises a stator 16 and a rotor 15. The stator 16 is fixed into the hermetically sealed vessel 1 by shrinkage fit for example. The rotor 15 is disposed rotatably within the stator 16 and the crank shaft 5 is fixed thereto by press-fitting for example. The electric motor 7 is supplied with electric power through the terminal 12.

The following description is now provided about a compressing action of the scroll compressor.

The rotor 15 rotates while being given a rotating force under a rotating magnetic field generated by the stator 16. As the rotor 15 rotates, the crank shaft 5 fixed to the rotor 15 performs a rotational motion. Under the action of the Oldham's ring 8, the movable scroll 3 connected to the crank shaft 5 performs a swivel motion (revolution) without rotation on its own axis. As a result of the swivel motion of the movable scroll 3, the check valve 19 opens the suction port 4*c* and refrigerant gas is sucked into the compressing mechanism 2 through the suction pipe 14 in accordance with an external refrigeration cycle.

The refrigerant gas thus sucked in passes through the suction port 4*c*, then through the suction chamber 10 in the fixed scroll 2, reaches the compression chambers 9, then is gradually compressed in the compression chambers 9, and is thereafter discharged into the closed vessel 1 through the discharge port 4*d*. The refrigerant gas thus discharged cools the electric motor 7 and is fed to an external refrigeration cycle through a discharge pipe 17.

Figure 2:
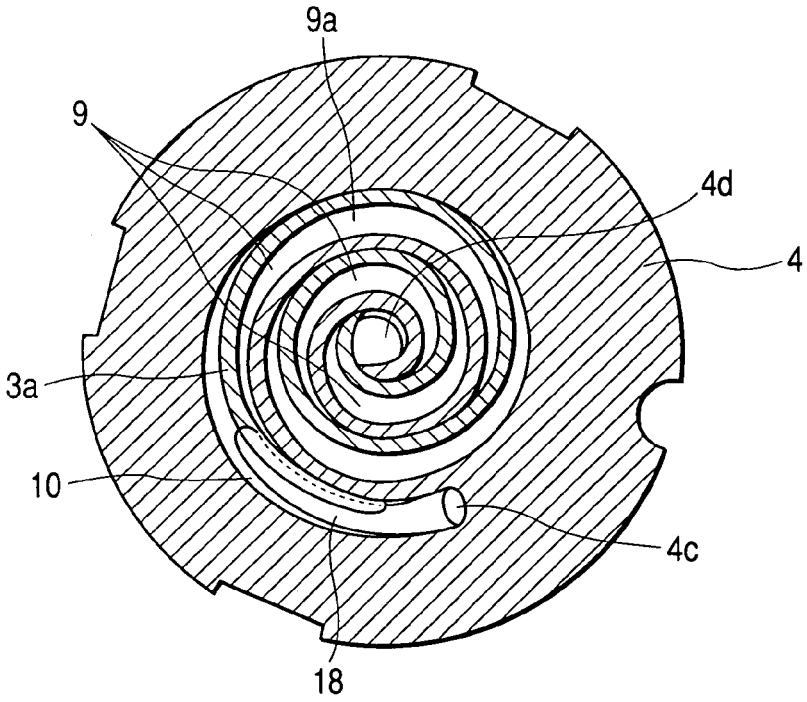
FIG. 2 is a sectional view showing a mutually engaged state of a fixed scroll lap and a movable scroll lap in the scroll compressor of FIG. 1.
Figure 3:
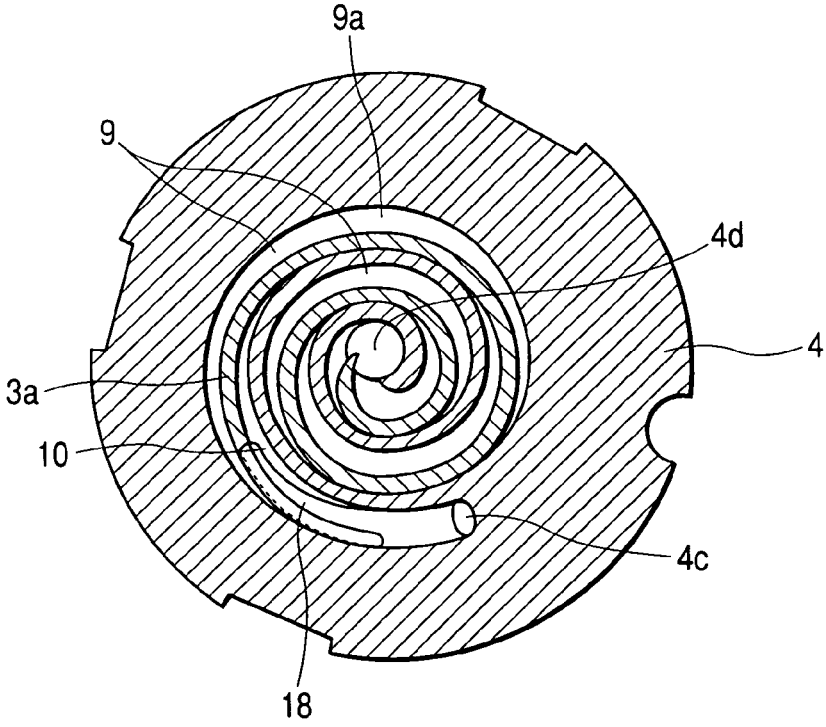
FIG. 3 shows a state in which a largest closed space is formed by an inner line side of the fixed scroll and an outer line side of the movable scroll in FIG. 2.
Figure 4:
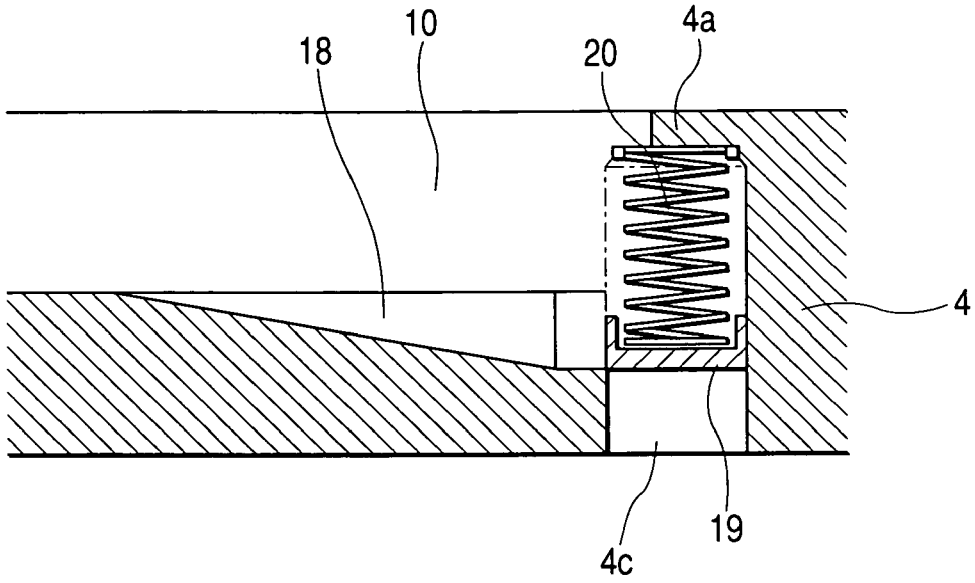
FIG. 4 is a sectional view of a portion of the fixed scroll alone in FIG. 1 passing through a gas refrigerant suction port.

Next, the details of the compressing mechanism 2 will be described with reference to FIGS. 2 to 4. FIG. 2 is a sectional view of both fixed scroll lap and movable scroll lap engaged with each other in the scroll compressor of FIG. 1, showing a state in which a largest closed space is formed by an outer line side of the fixed scroll and an inner line side of the movable scroll. FIG. 3 shows a state in which a largest closed space is formed by an inner line side of the fixed scroll and an outer line side of the movable scroll. FIG. 4 is a sectional view of a portion of the fixed scroll alone in FIG. 1 passing through a refrigerant gas suction port and is in an inverted relation to FIG. 1.

The compression chambers 9 (including the largest closed space 9*a*) shown in FIGS. 2 and 3 are formed by mutual engagement of winding ends of the fixed scroll lap 4*a* and the movable scroll lap 3*a* at approximately 180 degrees displaced positions. When the movable scroll 3 performs a swivel motion without rotation on its own axis in appearance relative to the fixed scroll 4, the largest closed space 9*a* surrounded by the outer line side of the fixed scroll lap 4*a* and the inner line side of the movable scroll lap 3*a* shown in FIG. 2 and the largest closed space 9*a* surrounded by the inner line side of the fixed scroll lap 4*a* and the outer line side of the movable scroll lap 3*a* shown in FIG. 3 are formed in an alternate manner. Through alternate compression processes, the refrigerant gas is discharged from the discharge port 4*d* into the hermetically sealed vessel 1.

As shown in FIGS. 2 and 3, a communication groove 18 is formed in the course in which the refrigerant gas is conducted through the suction pipe 14, then through the suction port 4*c* and suction chamber 10, into the largest closed space 9*a*. The communication groove 18 is formed depressedly in the base plate 4*b* of the fixed scroll 4. The communication groove 18 is in communication with the suction chamber 10 and extends from the suction port 4*c* toward the suction chamber.

The suction chamber side of the communication groove 18 extends up to near the portion where the largest closed space 9*a* surrounded by an outer line side of the fixed scroll lap 4*a* and an inner line side of the movable scroll lap 3*a* and the largest closed space 9*a* surrounded by an inner line side of the fixed scroll lap 4*a* and an outer line side of the movable scroll lap 3*a* are formed. The suction chamber side of the communication groove 18 is given a sufficient sealing width to prevent leakage of the refrigerant gas at the time of formation of the largest closed spaces. In other words, when the largest closed spaces in compression chambers 9 are formed alternately on the inner line side and the outer line side of the winding end portion of the movable scroll lap 3*a*, an inner end portion and an outer end portion on the suction chamber side of the communication groove 18 extend substantially in conformity with and along the inside of the inner and outer lines in the winding end portion. The communication groove 18 is formed as long as possible in order to maximize the effect of the communication groove 18.

By applying the communication groove 18 to a compression structure such that the winding ends of the fixed and movable scroll laps 4*a*, 3*a* are engaged with each other at approximately 180 degrees displaced positions, the communication groove 18 can be formed in such a single tapered triangular shape as fulfills its function for both the largest closed space 9*a* surrounded by an outer line side of the fixed scroll lap 4*a* and an inner line side of the movable scroll lap 3*a* and the largest closed space 9*a* surrounded by an inner line side of the fixed scroll lap 4*a* and an outer line side of the movable scroll lap 3*a*.

As shown in FIG. 4, the communication groove 18 is formed in communication with a side portion of the suction chamber 10 and extends from a side portion of the suction port 4*c* toward the suction chamber. The bottom of the communication groove 18 is gently inclined so as to become shallower from the suction port toward the suction chamber. The bottom of the communication groove 18 is gently inclined linearly at an angle of not larger than 45 degrees.

When the scroll compressor turns from ON to OFF, the refrigerant gas compressed in the compressing mechanism 2 is to be prevented from reverse flowing from the suction port 4*c* to the refrigeration cycle. To this end, the check valve 19 is disposed in the suction port 4*c*. When the check valve 19 is combined with the inclination in longitudinal section of the communication groove 18, the sectional inclination of the communication groove 18 exhibits the effect of promoting the response characteristic of the check valve 19. More particularly, when the refrigerant gas present within the compression chambers 9 begins to flow reverse, it must never fail to pass through the communication groove 18 before passing through the suction port 4*c*, and the direction of inclination of the longitudinal sectional shape of the communication groove 18 and the flowing direction of the refrigerant gas flowing in the same direction coincide with a closing direction of the check valve 19. Thus, the check valve 19 can be closed smoothly by utilizing the inclination of the communication groove 18.

According to this embodiment, since the bottom of the communication groove 18 is inclined so as to become shallower from the suction port side toward the suction chamber, it is possible to prevent the disturbance of the flow of refrigerant gas in the communication groove 18 and hence possible to diminish a flow path loss in the communication groove and thereby attain a decrease of the suction power loss. Consequently, it is possible to provide a highly efficient scroll compressor.

Besides, since the bottom of the communication groove 18 is gently inclined toward the suction chamber from a side portion of the suction port 4*c* which is formed vertically in the fixed scroll 4, more particularly, since the bottom of the communication groove 18 is gently inclined linearly at an angle of not larger than 45 degrees, the disturbance of the refrigerant gas flow in the communication groove 18 can be prevented more positively.

Further, the winding ends of the fixed and movable scrolls 4, 3 are displaced by approximately 180 degrees from each other, largest closed spaces in compression chambers 9 are formed alternately on the inner and outer line sides of the winding end portion of the movable scroll lap 3*a*, and the communication groove 18 is formed so that its inner and outer end portions extend substantially in conformity with and along the inside of inner and outer lines of the winding end portion at the time of forming the largest closed spaces in compression chambers 9. Consequently, the formation of a single communication groove enables the provisions of a less expensive structure while diminishing a loss caused by a compressing operation involving leakage which is generated in the suction stroke.

Figure 5:
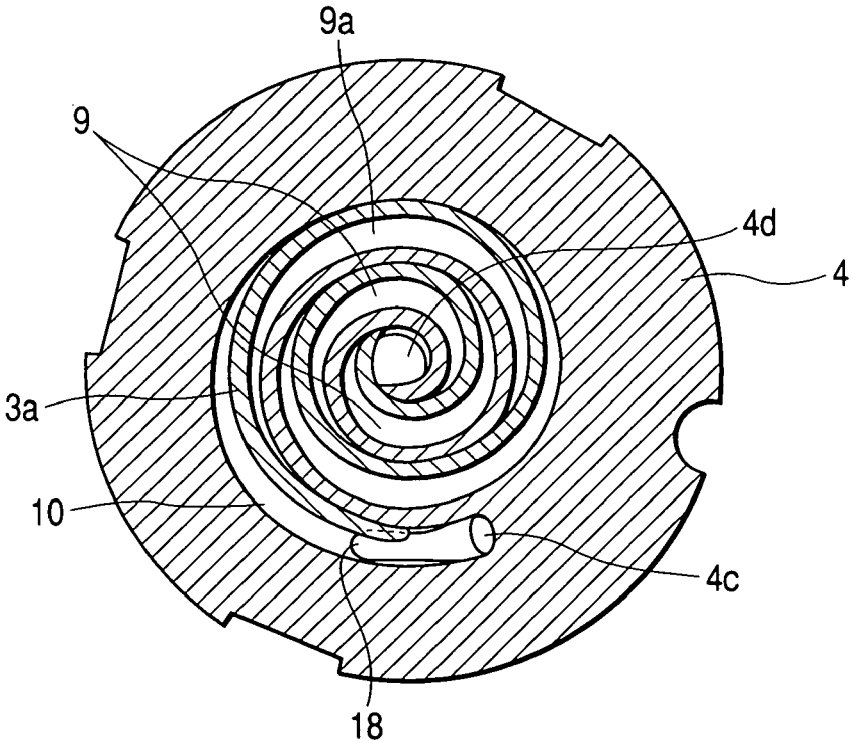
FIG. 5 is a view corresponding to FIG. 2 of a scroll compressor according to a second embodiment of the present invention.
Figure 6:
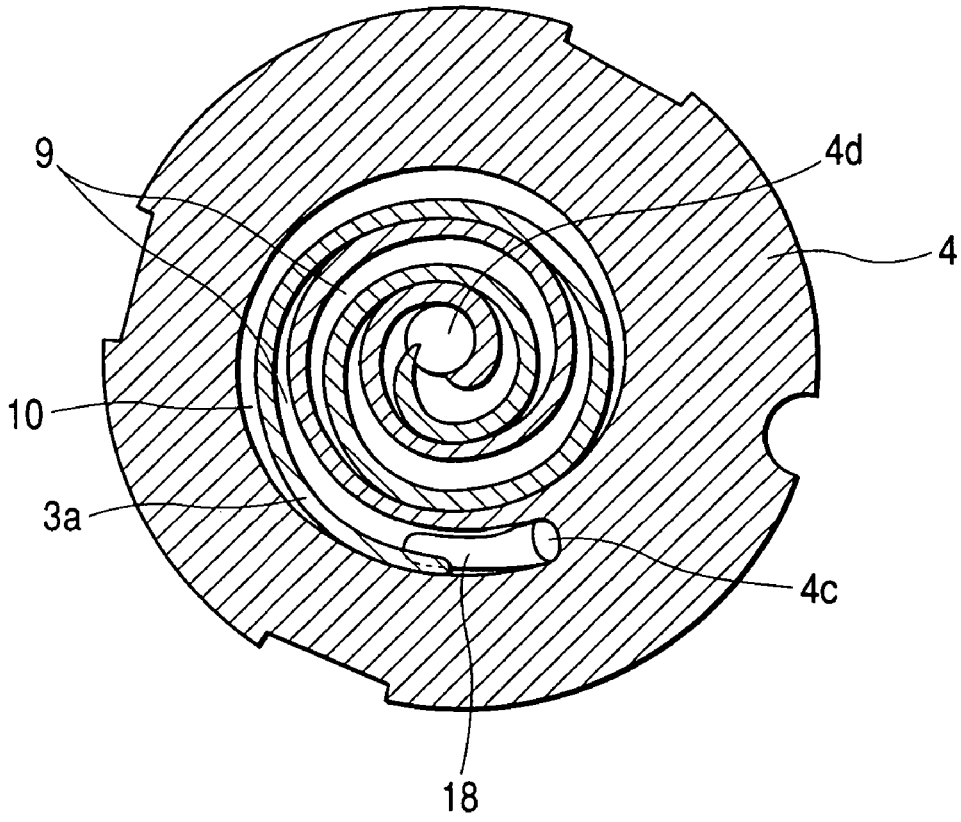
FIG. 6 is a view corresponding to FIG. 3 of a scroll compressor according to the second embodiment of the present invention.

A second embodiment of the present invention will now be described with reference to FIGS. 5 and 6. FIG. 5 corresponds to FIG. 2, showing a scroll compressor according to the second embodiment, and FIG. 6 corresponds to FIG. 3, showing the scroll compressor of the second embodiment. In the following point this second embodiment is different from the previous first embodiment. As to the other points this second embodiment is basically the same as the first embodiment.

In this second embodiment, a communication groove 18 is formed by only a circular arc closely similar to the scroll lap curve, a circular arc and a straight line. By forming the communication groove 18 in such a simple shape, it is possible to shorten the time required for machining the communication groove.

What is claimed is:

1. A scroll compressor, comprising spiral scroll laps provided on base plates of a fixed scroll and a movable scroll respectively, the movable scroll mounted so as to perform a swivel motion relative to the fixed scroll, the fixed scroll lap and the movable scroll lap are engaged with each other to form a suction chamber and compression chambers, a suction port communicating with the suction chamber is provided in the fixed scroll, a communication groove on the fixed scroll extending from the suction port to the suction chamber, a bottom of the communication groove inclining shallowly from the suction port side toward the suction chamber side, wherein at the time of forming a largest closed space in the compression chamber on an inner line side of a winding end portion of the movable scroll lap, the communication groove is formed in such a manner that an inside end portion thereof extends approximately in conformity with and along the inside of the inner line of the winding end portion.

2. A scroll compressor comprising spiral scroll laps provided on base plates of a fixed scroll and a movable scroll respectively, the movable scroll mounted so as to perform a swivel motion relative to the fixed scroll, the fixed scroll lap and the movable scroll lap are engaged with each other to form a suction chamber and compression chambers, a suction port communicating with the suction chamber is provided in the fixed scroll, a communication groove on the fixed scroll extending from the suction port to the suction chamber, a bottom of the communication groove inclining shallowly from the suction port side toward the suction chamber side, wherein winding ends of the fixed scroll and the movable scroll are displaced by approximately 180 degrees from each other, and wherein largest closed spaces in the compression chambers are formed alternately on an inner line side and an outer line side of a winding end portion of the movable scroll lap, and the communication groove is formed in such a manner that inner and outer end portions thereof extend approximately in conformity with and along the inside of the inner and outer lines of the winding end portion at the time of forming the largest closed spaces in the compression chambers.

3. A scroll compressor comprising spiral scroll laps provided on base plates of a fixed scroll and a movable scroll respectively, the movable scroll mounted so as to perform a swivel motion relative to the fixed scroll, the fixed scroll lap and the movable scroll lap are engaged with each other to form a suction chamber and compression chambers, a suction port communicating with the suction chamber is provided in the fixed scroll, a communication groove on the fixed scroll extending from the suction port to the suction chamber, and a bottom of the communication groove inclining shallowly from the suction port side toward the suction chamber side, wherein the suction port is formed vertically in the fixed scroll, the bottom of the communication groove is inclined from a side portion of the suction port toward the suction chamber, and a check valve is disposed in the suction port to prevent reverse-flowing of refrigerant gas from the suction chamber when the compressor is OFF.

4. A scroll compressor comprising upright spiral laps provided on base plates of a fixed scroll and a movable scroll respectively, the movable scroll is mounted so as to perform a swivel motion relative to the fixed scroll, the fixed scroll lap and the movable scroll lap are engaged with each other to form a suction chamber and compression chambers, a suction port communicating with the suction chamber is formed in the fixed scroll, and a communication groove extending from the suction port to the suction chamber is formed in the fixed scroll, wherein winding ends of the fixed scroll and the movable scroll are displaced by approximately 180 degrees from each other, largest closed spaces in the compression chambers are formed alternately on an inner line side and an outer line side of a winding end portion of the movable scroll lap, and the communication groove is formed in such a manner that inner and outer end portions thereof extend approximately in conformity with and along the inside of the inner and outer lines of the winding end portion at the time of forming the largest closed spaces in the compression chambers.

* * * * *